US011225741B2

(12) United States Patent
Jeong et al.

(10) Patent No.: US 11,225,741 B2
(45) Date of Patent: Jan. 18, 2022

(54) CLOTHES TREATING DEVICE

(71) Applicant: LG Electronics Inc., Seoul (KR)

(72) Inventors: Jaeyong Jeong, Seoul (KR); Keunjoo Kim, Seoul (KR); Dongsoo Lee, Seoul (KR); Oshin Kwon, Seoul (KR); Sangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 177 days.

(21) Appl. No.: 16/469,450

(22) PCT Filed: Dec. 15, 2017

(86) PCT No.: PCT/KR2017/014800
§ 371 (c)(1),
(2) Date: Jun. 13, 2019

(87) PCT Pub. No.: WO2018/111022
PCT Pub. Date: Jun. 21, 2018

(65) Prior Publication Data

US 2019/0382934 A1 Dec. 19, 2019

(30) Foreign Application Priority Data

Dec. 16, 2016 (KR) ..... 10-2016-0173009

(51) Int. Cl.
*D06F 31/00* (2006.01)
*D06F 23/04* (2006.01)
(Continued)

(52) U.S. Cl.
CPC ..... *D06F 31/00* (2013.01); *A47L 15/4214* (2013.01); *A47L 15/44* (2013.01);
(Continued)

(58) Field of Classification Search
CPC .... D06F 23/04; D06F 37/30–40; D06F 31/00; A47L 15/00–508
See application file for complete search history.

(56) References Cited

U.S. PATENT DOCUMENTS 4,371,067 A * 2/1983 Gerry ..... D06F 37/40 192/24
5,586,455 A * 12/1996 Imai ..... D06F 37/40 68/12.02

(Continued)

FOREIGN PATENT DOCUMENTS

CN 102337658 2/2012
CN 104790168 7/2015

(Continued)

OTHER PUBLICATIONS

Merriam-Webster, (n.d.). Fixed. In Merriam-Webster.com dictionary. Retrieved Dec. 10, 2020, from https://www.merriam-webster.com/dictionary/fixed (Year: 2020).*

(Continued)

*Primary Examiner* — Michael E Barr
*Assistant Examiner* — Omair Chaudhri
(74) *Attorney, Agent, or Firm* — Fish & Richardson P.C.

(57) ABSTRACT

A clothes treating device includes: a cabinet; a tub having an inlet at an upper part; a drum provided inside the tub and having a through-hole on a bottom surface thereof; a stirring part rotatably disposed in through-hole; a driving part provided on the lower part of the stirring part so as to provide power for rotating the stirring part and/or the drum; and a coupling provided between the stirring part and the driving part so as to be rotated by the power, and provided so as to rotate the stirring part and the drum in different directions or rotate only the stirring part when a water level of the tub is greater than or equal to a certain water level, and to rotate (Continued)

the stirring part and the drum in the same direction when the water level is less than to the certain water level.

9 Claims, 7 Drawing Sheets

(51) Int. Cl.

| | |
|---|---|
| ***D06F 29/00*** | (2006.01) |
| ***D06F 37/30*** | (2020.01) |
| ***D06F 37/40*** | (2006.01) |
| ***D06F 23/00*** | (2006.01) |
| ***D06F 21/06*** | (2006.01) |
| ***D06F 34/20*** | (2020.01) |
| ***D06F 33/47*** | (2020.01) |
| ***A47L 15/42*** | (2006.01) |
| ***A47L 15/44*** | (2006.01) |
| *D06F 25/00* | (2006.01) |
| *D06F 103/40* | (2020.01) |
| *D06F 105/54* | (2020.01) |
| *D06F 105/60* | (2020.01) |
| *D06F 105/62* | (2020.01) |
| *D06F 34/24* | (2020.01) |
| *D06F 37/42* | (2006.01) |
| *A47L 15/00* | (2006.01) |

(52) U.S. Cl.

CPC ..... *D06F 23/04* (2013.01); *D06F 29/00* (2013.01); *D06F 33/47* (2020.02); *D06F 34/20* (2020.02); *A47L 15/00* (2013.01); *D06F 21/06* (2013.01); *D06F 23/00* (2013.01); *D06F 25/00* (2013.01); *D06F 34/24* (2020.02); *D06F 37/304* (2013.01); *D06F 37/40* (2013.01); *D06F 37/42* (2013.01); *D06F 2103/40* (2020.02); *D06F 2105/54* (2020.02); *D06F 2105/60* (2020.02); *D06F 2105/62* (2020.02)

(56) References Cited

U.S. PATENT DOCUMENTS

| | | | | |
|---|---|---|---|---|
| 6,202,451 | B1 * | 3/2001 | Park | D06F 37/40 68/133 |
| 2014/0109627 | A1 * | 4/2014 | Lee | D06F 17/10 68/133 |
| 2014/0182066 | A1 * | 7/2014 | Chang | D06F 33/00 8/137 |

FOREIGN PATENT DOCUMENTS

| | | | | |
|---|---|---|---|---|
| CN | 104790168 | A * | 7/2015 | |
| JP | H07265578 | | 10/1995 | |
| JP | H07265579 | | 10/1995 | |
| KR | 100359340 | | 1/2003 | |
| KR | 20030024968 | A * | 3/2003 | |
| KR | 100438296 | | 7/2004 | |
| KR | 20130117730 | | 10/2013 | |
| KR | 102058058 | B1 * | 12/2019 | D06F 37/40 |

OTHER PUBLICATIONS

Chinese Office Action in Chinese Application No. 201780078154.4, dated Oct. 26, 2020, 24 pages (with English translation).

Extended European Search Report in European Application No. 17881310.1, dated May 15, 2020, 9 pages.

PCT International Search Report and Written Opinion in International Application No. PCT/KR2017/014800, dated Mar. 22, 2018, 24 pages (with English translation).

* cited by examiner

CLOTHES TREATING DEVICE

CROSS-REFERENCE TO RELATED APPLICATIONS

This application is a National Stage application under 35 U.S.C. § 371 of International Application No. PCT/KR2017/014800, filed on Dec. 15, 2017, which claims the benefit of Korean Application No. 10-2016-0173009, filed on Dec. 16, 2016. The disclosures of the prior applications are incorporated by reference in their entirety.

FIELD

The present invention relates to a laundry treating apparatus.

BACKGROUND

Generally, a laundry treatment apparatus is understood to include an apparatus adapted to wash laundry, an apparatus adapted to dry laundry, and an apparatus adapted to perform both washing and drying of laundry. In this instance, the laundry treating apparatus may perform only a washing or drying function or both of the washing and drying functions. Recently, such the laundry treating apparatus is provided with a steam supply device so as to have a refresh function for removing wrinkles, bad smell, friction from clothes.

Meanwhile, a conventional laundry treating apparatus is classified into a front load type or a top load type according to a direction in which clothes are unloaded there from. It is also classified into a vertical type that has a vertically rotary pulsator or tub and a horizontal type that has a horizontally rotary drum.

A typical example of the horizontal type is a drum washing or drying machine.

A front-loading laundry treatment apparatus (also called a drum washing machine) is constructed to allow laundry to be put into the apparatus from the front of the apparatus and has an introduction port through which laundry can be put into the apparatus and a shaft of the drum provided in parallel with the ground or tilted a preset angle. A top loading laundry treating apparatus is constructed to allow laundry to be put into the apparatus from the top and has the shaft of the drum vertically provided with respect to the ground.

Such the laundry treating apparatuses tend to be gradually enlarged in response to users' demands. In other words, the exterior size of the washing machines used for family use becomes larger gradually.

In general, each family has one large-capacity laundry treating apparatus and use it several times when classifying laundry according to types of fabric or color and washing the classified laundry. For example, when trying to classify clothes into clothes for adults, underwear and clothes for infants and wash the classified clothes dividedly, the user uses the laundry treating apparatus and then use again after finishing the washing.

Accordingly, it takes quite a long time and a lot of energy to complete the washing.

In addition, it is not preferred in terms of energy saving to use the conventional large-capacity laundry treating apparatus in washing a small amount of clothes. Most of the washing courses provided in the large-capacity laundry treating apparatus are not preset for a much amount of laundry and requires a lot of water that has to be used. Also, such the conventional large-capacity laundry treating apparatus has to rotate a large-capacity drum or inner tub only to consume a lot of electric energy.

Moreover, the washing courses are preset for the large amount of the laundry and require a relatively long washing time.

The large-capacity laundry treating apparatus has washing courses for normal clothes and then it is not proper to wash delicate fabric (e.g., lingerie or underwear or clothes for infants)

Even washing a small amount of laundry frequently, the large-capacity laundry treating apparatus is not proper. Users collect laundry over several days or more to wash the collected laundry at one go.

It is not recommended to neglect and collect such lingerie or clothes for infants. Contaminants could be stuck or permanent in the fabric of such the laundry if the laundry is neglected for a long time. Accordingly, the washing might not be performed disadvantageously.

There are demands for a small-sized laundry treating apparatus with a small-capacity, compared with the conventional large-sized laundry treating apparatus.

It is not preferred in terms of space use and an exterior design to install two apparatuses in a house side by side, even in case of the small-sized laundry treating apparatuses.

Recently, to solve such disadvantages, a laundry treating apparatus is released that includes a front-load type and a top-load type mounted on the front-load type.

The top-load type laundry treating apparatus is mounted on a top of the front-load type to wash a small amount of laundry and enhance the space use.

Meanwhile, the conventional top-load type laundry treating apparatus typically includes a drum rotatably provided and holding laundry; and a pulsator provided in a bottom of the drum to enhance washing efficiency. The drum or the pulsator is rotatable or both are rotatable in the same or reverse direction to deduce the hands-scrubbing-like effect.

However, the top-load type laundry treating apparatus used as an auxiliary device is relatively low such that the ratio of the water to the laundry is not so the ratio of the laundry to the water is not so high.

Accordingly, laundry might be twisted or entangled disadvantageously when the drum and the pulsator are rotated in the reverse directions or one of the two is rotated.

Such entanglement could enhance the washing efficiency of the laundry in a wash cycle but become serious in a spin cycle configured to rotate the drum or the pulsator at a high speed so as to remove moisture from the laundry, only to cause damage to the fabric of the laundry.

Moreover, when the laundry is seriously entangled even in the wash cycle, detergent might be supplied to the entire laundry or foreign substances or dirt might fail to be separated from the laundry to deteriorate the washing efficiency.

DETAILED DESCRIPTION OF THE INVENTION

Technical Problem

An object of the present invention is to provide a laundry treatment apparatus which may rotate a drum and a pulsator of a top-load type laundry treating apparatus in the same direction or independently.

Another object of the present invention is to provide a laundry treatment apparatus which may independently rotate the drum and the pulsator in a wash cycle and in the same direction in a spin cycle.

A further object of the present invention is to provide a laundry treatment apparatus which may minimize laundry entanglement.

A further object of the present invention is to provide a laundry treatment apparatus which may minimize laundry entanglement of a top-load type laundry apparatus, when a top-load type laundry treating apparatus is used as an auxiliary laundry treating apparatus provided on a top of a front-load type laundry treating apparatus.

Technical Solution

To achieve these objects and other advantages and in accordance with the purpose of the invention, as embodied and broadly described herein, a laundry treating apparatus comprises a cabinet defining an exterior design of the apparatus; a tub provided in the cabinet and configured to hold water, with an opening formed in a top; a drum rotatably mounted in the tub and configured to accommodate laundry, with a through-hole formed in a bottom surface; an agitation unit rotatably provided in the through-hole and configured to agitate the laundry; a drive unit provided in a lower area of the agitation unit and configured to provide a drive force to at least one of the agitation unit and the drum; a coupling provided between the agitation unit and the drive unit and rotatable by using the drive force to rotate the agitation unit and the drum in the reverse directions or only the agitation unit, when a water level is a preset level or more in the tub, and rotate both of the agitation unit and the drum in the same direction, when the water level is less than a preset level in the tub.

The laundry treating apparatus may further comprise a shaft fixing unit provided to connect the drive unit with a bottom surface of the drum, wherein the coupling is coupled to the shaft fixing unit and transmits the drive force to the drum, when the water level is less than a preset level in the tub, and the coupling is separated from the shaft fixing unit and shuts off the drive force from being transmitted to the drum, when the water level is a preset level or more in the tub.

The drive unit may comprise a stator fixed to the tub and configured to generate a rotation magnetic field; a rotor rotatable by the rotation magnetic field; a drive rotation shaft rotatable by the rotor through the tub; and a shaft accommodation unit configured to rotatably accommodate the drive rotation shaft, while having the drive rotation shaft pass there through.

The shaft fixing unit may comprise a hub comprising a shaft penetrating portion having the shaft accommodation unit coupled to a lower area and the drive rotation shaft pass there through; and a fixing arm radially extended from the hub and coupled to a bottom surface of the drum, and the agitation unit may be coupled to one end of the drive rotation shaft, and the coupling is vertically movable along the drive rotation shaft from an upper area of the hub.

The coupling may comprise a power transmission unit coupled to the drive rotation shaft and configured to be supplied the drive force.

The drive rotation shaft may comprise a shaft body connected with the rotor; a shaft gear portion extended from the shaft body and comprising a first gear provided in an outer circumferential surface of the area projected from the hub, and the shaft penetrating unit may comprise a hub gear partially accommodating the shaft gear portion, spaced a preset distance apart from the shaft gear portion, and comprising a second gear provided in an inner circumferential surface, and the power transmission unit may comprise a coupling gear comprising a third gear movable along a longitudinal direction of the shaft gear portion and configured to engage with the first gear in an inner circumferential surface; and a fourth gear configured to engage with the second gear in an outer circumferential surface, when the power transmission unit is inserted between the shaft gear portion and the hub gear.

The coupling may comprise a fixed plate extended from an upper area of the coupling gear to fix the coupling gear thereto; and an accommodating rib extended from one end of the fixed plate to detachably accommodate the hub gear.

The coupling may comprise an extended rib extended from the accommodating rib; and an agitation coupling unit projected from one end of the extended rib and detachably coupled to a lower area of the agitation unit to provide a predetermined space in a lower area to accommodate water.

The agitation unit may comprise an agitation unit body defining a main body; a central portion provided in the center of the agitation unit body and coupled to one end of the shaft gear portion to be rotatable together with the shaft gear portion; and an agitation arm radially projected from the central portion and configured to agitate the laundry, and the central portion is upwardly projected from a lower area to detachably accommodate the coupling.

The agitation unit may further comprise a coupling rib downwardly extended from the central portion and configured to seat the power transmission unit in the extended rib.

The shaft accommodation unit may comprise an accommodation pipe provided to rotatably accommodate a predetermined area of the drive rotation shaft; an accommodation fixing portion extended from an upper area of the accommodation pipe and coupled to the hub; and an accommodation bearing provided in an inner circumferential surface of the accommodation pipe and configured to shut off the drive force of the drive rotation shaft from being transmitted to the shaft accommodation unit.

The shaft penetrating unit may further comprise a hub coupling unit detachably provided in the hub and extended from an outer circumferential surface of the hub gear to be coupled to the hub.

The laundry treating apparatus may further comprise a shaft fixing unit provided to connect the drive unit with a bottom surface of the drum, wherein the drive unit may comprise a stator fixed to the tub and configured to generate a rotation magnetic field; a rotor rotatable by the rotation magnetic field; a drive rotation shaft rotatable by the rotor through the tub; and a shaft accommodation unit configured to rotatably accommodate the drive rotation shaft, while having the drive rotation shaft pass there through, and the shaft fixing unit may comprise a hub comprising a shaft penetrating portion having the shaft accommodation unit coupled to a lower area and the drive rotation shaft pass there through; and a fixing arm radially extended from the hub and coupled to a bottom surface of the drum, and the laundry treating apparatus may further comprise a gear box provided in an upper area of the hub and configured to rotate the agitation unit and the drum in the reverse directions by the drive force while being coupled to one end of the drive rotation shaft, and the coupling may be provided between the agitation unit and the gear box to be supplied the drive force from the gear body when the water level is a preset level or more in the tub and supplied the drive force from the hub when the water level is less than a preset level in the tub.

The gear box may comprise a sun gear coupled to one end of the drive rotation shaft and rotatable together with the drive rotation shaft; at least one planet gear configured to engage with the sun gear and revolve along an outer circumferential surface of the sun gear; a ring gear provided in an outer circumferential surface of the planet gear and configured to be rotatable while engaging with the planet gear; a carrier provided to rotatably accommodate a shaft of the planet gear and coupled to the hub while rotated in a same direction with the revolving direction of the planet gear; a rotation housing coupled to an upper area of the ring gear and configured to be rotatable together with the ring gear in the reverse direction of the rotating carrier; a body shaft coupled to an upper area of the rotating housing; and a gear housing accommodating the rotation housing to allow the body shaft to be projected there through and coupled to the carrier, and the agitation unit is coupled to one end of the body rotation shaft, while rotatable with no relation with the body rotation shaft.

The coupling may be vertically movable along a longitudinal direction of the body rotation shaft and configured to be supplied the drive force from the body rotation shaft, when a water level is a preset level or more in the tub, and supplied the drive force from the gear housing, when the water level is less than a preset level in the tub.

The laundry treating apparatus may further comprise a housing gear provided in an upper area of the gear housing and configured to accommodate at least predetermined are of the body rotation shaft, spaced a preset distance apart from the body rotation shaft, the housing gear comprising a fifth gear provided in an inner circumferential surface, wherein the body rotation shaft comprises a body gear unit comprising a sixth gear provided in an outer surface of the area projected from the housing gear, and the power transmission unit comprises a coupling gear comprising a third gear configured to engage with the sixth gear in an inner circumferential surface, when the power transmission unit is separated from the housing gear; and a fourth gear configured to engage with the fifth gear in an outer circumferential surface, when the power transmission unit is inserted between the body gear unit and the housing gear.

The coupling may further comprise a fixed plate extended from an upper area of the coupling gear and having the coupling gear fixed thereto; an accommodation rib extended from one end of the fixing plate to detachably accommodate the housing gear; a housing rib extended from one end of the accommodation rib and configured to detachably accommodate the gear housing; an extended rib extended from the housing rib, and an agitation coupling portion projected from one end of the extended rib and detachably coupled to a lower area of the agitation unit, while providing a predetermined space for accommodating water.

The agitation unit may comprise an agitation unit body defining a main body; a central portion provided in a center of the agitation unit body and coupled to one end of the body rotation shaft, in a state of being rotatable independently from the body rotation shaft; and an agitation arm radially projected from the central portion and configured to agitate the laundry, and the central portion is upwardly projected to detachably accommodate the coupling in the lower area.

The agitation unit may further comprise a coupling rib downwardly extended from the central portion to be seated in the extended rib.

The shaft accommodation unit may comprise an accommodating pipe configured to rotatably accommodate a predetermined area of the drive rotation shaft; an accommodating fixing portion extended from an upper area of the accommodating pipe and coupled to the hub; and an accommodating bearing provided in an inner circumferential surface of the accommodating pipe and configured to shut off the drive power of the drive rotation shaft from being transmitted to the shaft accommodating portion.

The coupling may be made of a material having a smaller specific gravity than water.

In another aspect of the present disclosure, a laundry treating apparatus comprises a first cabinet comprising an opening formed in a front; a second cabinet provided on a top of the first cabinet and comprising an opening formed in a top; a tub provided in the second cabinet and configured to hold water, the tub comprising an introduction opening in communication with the opening; a drum rotatably mounted in the tub and configured to accommodate laundry, the drum comprising a penetrating hole formed in a bottom surface; an agitation unit rotatably provided in the penetrating hole and configured to agitate the laundry; a drive unit provided in a lower area of the agitation unit and configured to provide a drive force for rotating at least one of the agitation unit and the drum; and a coupling provided between the agitation unit and the drive unit and rotatable by using the drive force to rotate the agitation unit and the drum in the reverse directions or only the agitation unit, when a water level is a preset level or more in the tub, and rotate both of the agitation unit and the drum in the same direction, when the water level is less than a preset level in the tub.

Advantageous Effects

As is apparent from the above description, the present disclosure has the effect of providing a laundry treating apparatus which may rotate a drum and a pulsator of a top-load type laundry treating apparatus in the same direction or independently.

In addition, the present disclosure has the effect of providing a laundry treating apparatus which may independently rotate the drum and the pulsator in a wash cycle and in the same direction in a spin cycle.

In addition, the present disclosure has the effect of providing a laundry treating apparatus which may minimize laundry entanglement.

In addition, the present disclosure has the effect of providing a laundry treating apparatus which may minimize laundry entanglement of a top-load type laundry apparatus, when a top-load type laundry treating apparatus is used as an auxiliary laundry treating apparatus provided on a top of a front-load type laundry treating apparatus.

DESCRIPTION OF SPECIFIC EMBODIMENTS

Reference will now be made in detail to the preferred embodiments of the present invention, examples of which are illustrated in the accompanying drawings.

It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

Figure 1:
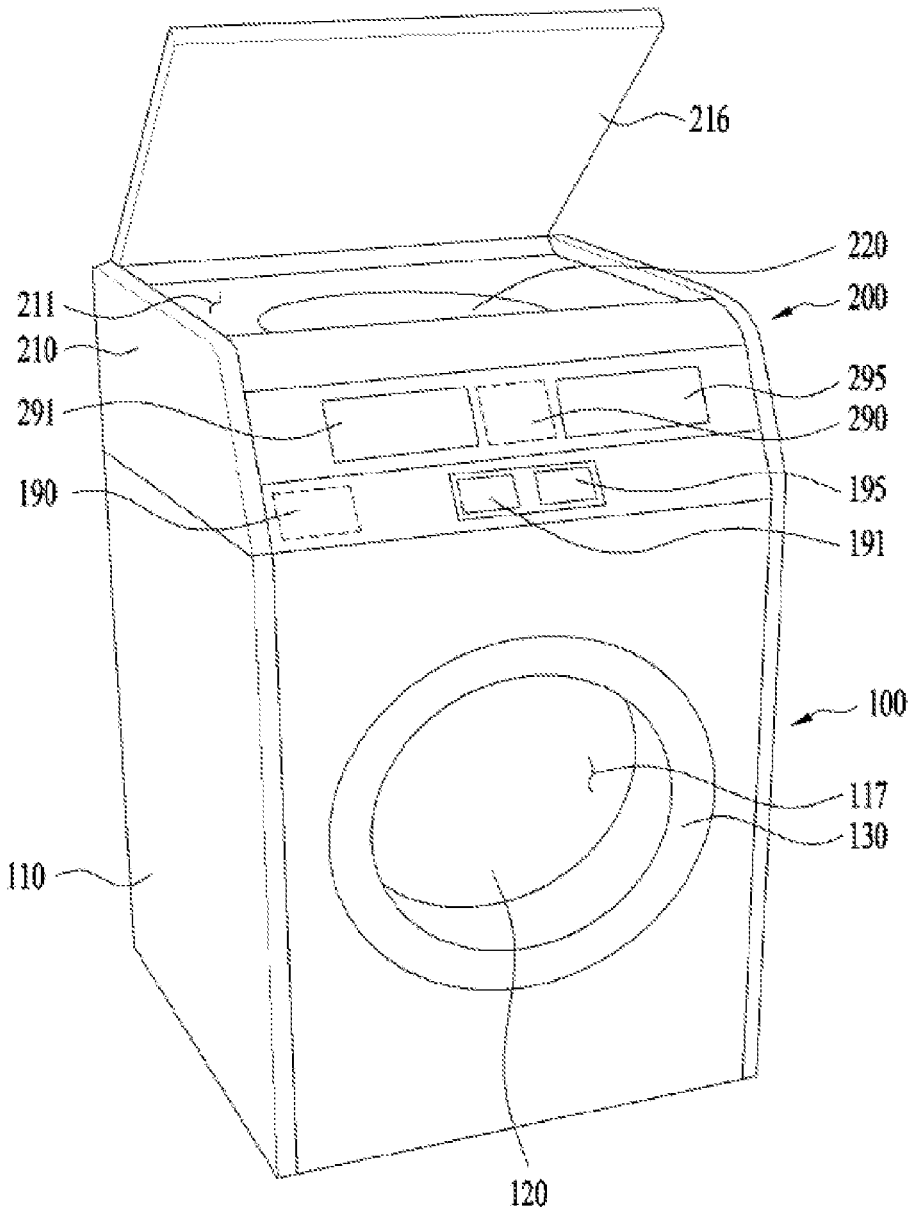
FIG. 1 is a diagram illustrating an exterior design of a laundry treating apparatus in accordance with the present disclosure.
Figure 2:
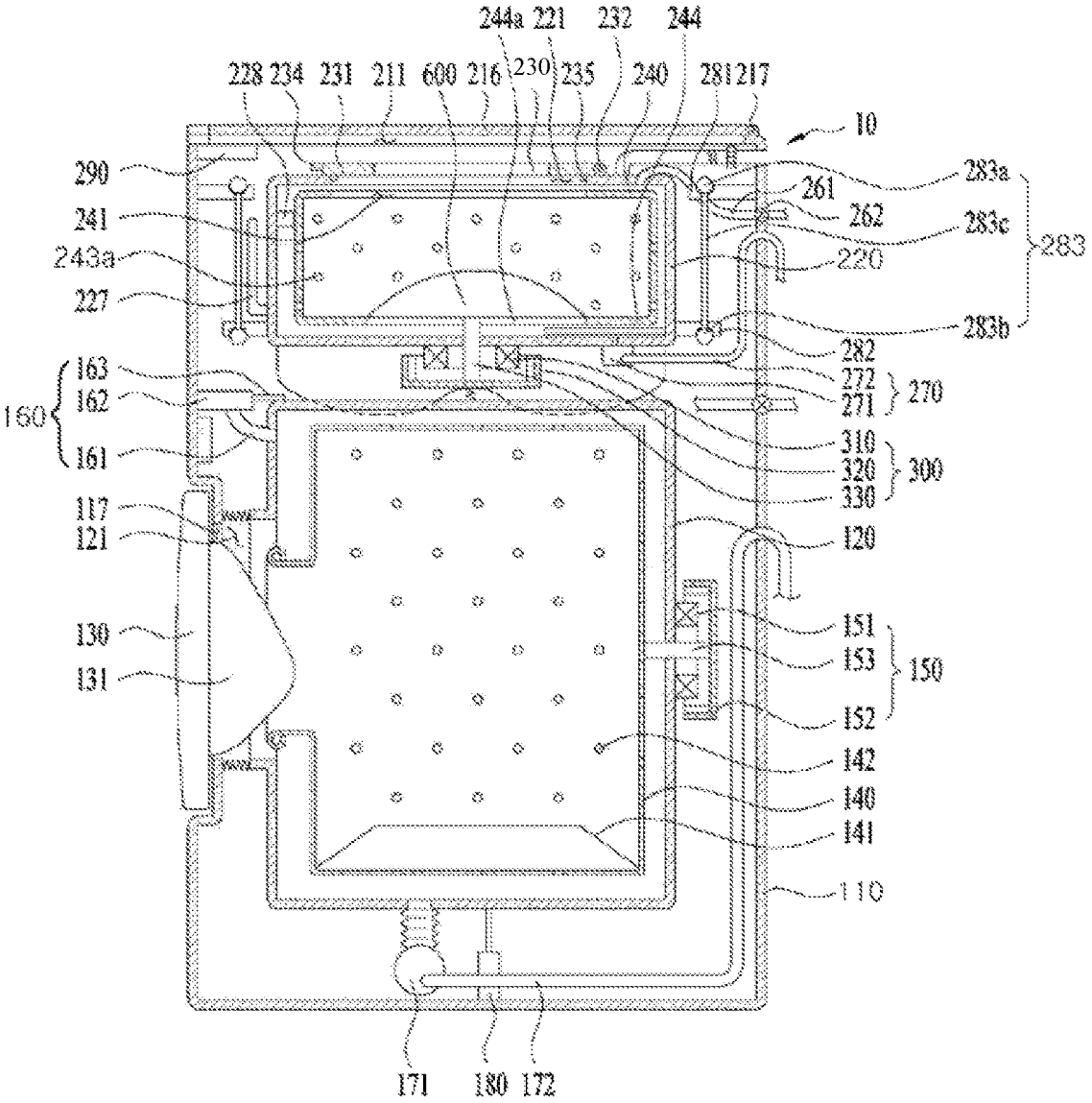
FIG. 2 is a diagram illustrating a structure of the laundry treating apparatus.

As shown in FIGS. 1 and 2, the laundry treatment apparatus 10 includes a front-load type laundry treating apparatus 100 provided in a bottom; and a top-load type laundry treating apparatus 200 provided on a top of the front-load type laundry treating apparatus 200.

In this instance, the front-load type laundry treating apparatus means a laundry treating apparatus which has an opening formed in the front of the apparatus and a shaft of a drum provided in parallel to the ground or tilted a preset angle. The top-load type laundry treating apparatus means a laundry treating apparatus which has an opening formed in the top of the apparatus and has a shaft of a drum vertical to the ground.

However, that is one of examples and embodiments of the present disclosure may not exclude that the top-load type laundry treating apparatus 200 has the opening formed in the top and the shaft of the drum vertical to the ground.

Hereinafter, the front-load type laundry treating apparatus is defined as the first laundry treating apparatus and the top-load type laundry treating apparatus 200 is defined as the second laundry treating apparatus.

The laundry treating apparatus in accordance with one embodiment of the present disclosure includes the first laundry treating apparatus 100 and the second laundry treating apparatus 200 that are provided independently. The first laundry treating apparatus 100 and the second laundry treating apparatus 200 may be coupled to each other and the first and second laundry treating apparatuses 100 and 200 may be integrally formed with each other as one body.

The laundry treating apparatus in accordance with one embodiment may include a first cabinet 110 having a first opening 117 formed in the front of the apparatus; a first laundry accommodation unit 120 and 140 provided in the first cabinet and configured to hold laundry; a second cabinet 210 having a second opening 211 and provided on a top of the first cabinet 110; and a second laundry accommodation unit 220 and 240 provided in the second cabinet 210 and configured to accommodate the laundry.

In other words, the first cabinet 110 may define an exterior design of the first laundry treating apparatus 100 and the second cabinet 210 may define an exterior design of the second laundry treating apparatus 200.

The first and second cabinets 110 and 210 may be coupled to each other and define the overall exterior design of the laundry treating apparatus in accordance with the embodiment of the present disclosure.

Alternatively, the first and second cabinets 110 and 210 may be integrally formed with each other as one body and define the entire exterior design of the laundry treating apparatus in accordance with the embodiment of the present disclosure.

On the front of the first cabinet 110 may be provided a first display unit 195 configured to display an operational state of the first laundry treating apparatus 100; a first input unit 191 configured to receive an input of an operation command for the first laundry treating apparatus 100; and a first control unit 190 configured to control the overall operation of the first laundry treating apparatus 100.

On the front of the second cabinet 210 may be provided a second display unit 295 configured to display an operational state of the second laundry treating apparatus 200; a second input unit 291 configured to receive an input of an operation command for the second laundry treating apparatus 200; and a second control unit 290 configured to control the overall operation of the second laundry treating apparatus 200.

In this instance, when the second laundry treating apparatus 200 may be mounted on the top of the first laundry treating apparatus 100 or the first and second laundry treating apparatuses 100 and 200 are integrally formed with each other, the first or second control unit 190 or 290 may control the overall operations of the first and second laundry treating apparatuses.

An operational command for the first and second laundry treating apparatuses may be input to the first input unit 191 or the second input unit 291.

Each of the first and second display units 195 and 295 may include a display panel (e.g., LCD or LED) and a speaker configured to generate sound so as to deliver information to the user.

In other words, the first and second display units 195 and 295 may display information about the laundry treating apparatuses to the user or transmit an alarm in case of an alarm even.

Meanwhile, the first laundry treating apparatus 100 may be provided as a washing machine for washing laundry by using detergent and water or dryer for drying laundry by using hot air.

When the first laundry treating apparatus 100 is provided as the washing machine, the first laundry accommodation unit 120 and 140 may include a first tub 120 having a first introduction opening 121 in communication with the first opening 117 and providing a predetermined space for storing water; and a first drum 140 rotatably mounted in the first tub 120 and provided to accommodate laundry.

When the first laundry treating apparatus 100 is provided as the dryer, the first laundry accommodation unit 120 and 140 may include a first drum 140 rotatably mounted in the first cabinet 110 and provided to accommodate laundry.

FIGS. 1 and 2 shows that the first laundry treating apparatus 100 is the washing machine and it is not excluded that the first laundry treating apparatus 100 is the dryer.

In addition, the second laundry treating apparatus 200 may be provided as a washing machine configured to wash laundry by using detergent and water or a dryer configured to dry the laundry by using hot air.

When the second laundry treating apparatus 200 is provided as the washing machine, the second laundry accommodation unit 220 and 240 may include a second tub 220 having a second introduction opening 221 in communication with the second opening 217 and providing a predetermined space for storing water; and a second drum 240 rotatably mounted in the second tub 220 and provided to accommodate laundry.

A water level sensor 227 may be provided in a predetermined area of the second tub 220 to sense a water level in the second tub 220. A temperature sensor 228 may be provided in an inner circumferential surface of the second tub 220 to sense the temperature inside the second tub 220.

When the second laundry treating apparatus 200 is provided as the dryer, the second laundry accommodation unit 220 and 240 may include a second drum 240 rotatably mounted in the second cabinet 210 and provided to accommodate the laundry.

FIGS. 1 and 2 show that the second laundry treating apparatus 200 is the washing machine and it is not excluded it is the dryer.

The first laundry treating apparatus 100 may include a first door 130 configured to open and close the first opening 117 and the first door 130 may include a door gasket 131 provided to seal the first introduction opening 121 of the first tub 120 in the first opening 117.

Meanwhile, the first laundry treating apparatus 100 may include a first water supply unit 160 configured to supply water to the first tub 120; and a first water discharge unit 170 configured to discharge the water from the first tub 120.

The first water supply unit 160 may include a first water supply pipe 161 configured to supply water from an external water supply source; a detergent box 162 provided to mix the supplied water to the detergent and supply the mixture to the first tub 120; and a first supply pipe 163 provided to move the water and detergent from the detergent box 162 to the first tub 120, in communication with the first tub 120.

The first water discharge unit 170 may include a first discharge pipe 172 provided in a lower portion of the first tub 120 to discharge the water; and a discharge pump 171 configured to discharge the water from the first water discharge pipe 172 outside the first cabinet 210.

Meanwhile, the first laundry treating apparatus 100 may include a support damping unit 180 configured to support the first tub 120 with respect to the first cabinet 110 and damp the vibration generated in the first tub 120 to prevent the vibration from being transmitted to the first cabinet 110.

The support damping unit 180 may be a damper or spring or a combined structure of the damper and spring. A plurality of support damping units may be provided.

The support damping units 180 may be provided in an upper or lower portion of the first tub 120 or both of the portions.

Meanwhile, the first laundry treating apparatus 100 may include a first drive unit 150 configured to rotate the first drum 140.

The drive unit 150 may include a first stator 151 provided in a rear surface of the first tub 120 and configured to generate a rotation magnetic field; a first rotor 152 rotatable by the rotation magnetic field of the first stator 151; and a shaft 153 having one end connected with the first rotor 152 and the other end connected to the first drum 140 through the first tub 120.

The shaft 153 may be provided in parallel with the ground or inclined upwardly with respect to the ground.

The first drum 140 may include a lifter 141 configured to lift the laundry when the first drum 140 is rotating and enhance the washing efficiency; and a plurality of through-holes 142 provided in an inner circumferential surface of the first drum 140 to draw or discharge the water of the first tub 120.

Meanwhile, when provided on the top of the first laundry treating apparatus 100, the second laundry treating apparatus 200 has to have a limited height. In other words, the higher is the second laundry treating apparatus 200, the more washing volume the second laundry treating apparatus 200 has. However, it will be difficult for the user to approach the second opening 211 disadvantageously.

Accordingly, the second tub 220 has to be relatively low such that it could be more likely to discharge the water or laundry held in the second tub 220 outside the second tub 220.

The second tub 220 may include a tub door 230 provided to open and close the second introduction opening 221. The tub door 230 may open and close the second introduction opening 221 to prevent the water or laundry held in the second tub 220 from being discharged outside the second tub 220.

In other words, the tub door 230 may include a second introduction opening 221 provided in the top and communicable with the second opening 211 and configured to open and close the second introduction opening 221.

The tub door 230 may include a frame 231 defining an exterior design; a window provided to make the inside of the second tub 220 seen by the user; a hinge 232 provided to rotatably couple the frame 231 to the top of the second tub 220; a handle 234 provided to detachably couple the frame 231 to the top of the second tub 220; and a sealing portion 235 provided to seal the tub door 230 with the second introduction opening 221.

Accordingly, the tub door 230 may be rotatably coupled to the top of the second tub 220. Meanwhile, the second laundry treating apparatus 200 may include a cover door 216 provided to open and close the second opening 211. The cover door 216 may define the top of the second cabinet 210 and be rotatably coupled to a predetermined area of the second cabinet 210.

Meanwhile, when the tub door 230 is provided, the second cabinet 210 may have no cover door 216. In other words, the tub door 230 may be exposed outside via the second opening 211, while rotatably opening and closing the second introduction opening 221.

The second laundry treating apparatus 200 may include a second water supply unit 260 configured to supply water to the second tub 220; and a second water discharge unit 270 configured to discharge the water from the second tub 220.

The second water supply unit 260 may include a second water supply pipe 261 configured to supply water to the second tub 220; and a water supply valve 262 configured to adjust the amount of the water flowing in the second water supply pipe 261.

The second water discharge unit 270 may include a second water discharge pipe 272 provided in the lower portion of the second tub 220 and configured to discharge the water from the second tub 220; and a second water discharge pump 271 configured to discharge the water of the second water discharge pipe 272 outside the second cabinet 210.

At this time, the second water supply unit 260 and the second water discharge unit 270 may be independent from the first water supply unit 160 and the first water discharge unit 170.

As the second laundry treating apparatus 200 is detachably provided in the first laundry treating apparatus 100, the first and second laundry treating apparatuses may be independently provided from each other.

Meanwhile, the second tub 220 may include a support 280 provided to support the second tub 220 to the second cabinet 210.

The support 280 may include a first support 281 provided in the second cabinet 210; a second support 282 provided in the second tub 220; and a connection unit provided to connect the first and second supports 281 and 282 with each other.

The first support 281 may be provided higher than the second support 282. One end of the connection unit 283 may be secured to the first support 281 and the other end may support the second support 282 to secure the second tub 220 to the second cabinet 210.

The first support 281 may be provided as a first bracket projected from the second cabinet 210 and the second support 282 may be provided as a second bracket projected from the second tub 220. The second connection unit 283 may connect the first and second brackets with each other, while being vertical with respect to the ground.

Accordingly, the volume occupied by the support unit 280 including second connection unit 283 may be minimized enough to expand the washing capacity.

The second connection unit 283 may include a first connection unit 283*a* disposed through the first support 281; a second connection unit 283*b* supporting the second support 282, penetrating it; and a connection bar 283*c* provided to connect the first connection unit 283*a* and the second connection unit 283*b* with each other.

Each of the first and second connection units 283*a* and 283*b* has a larger diameter than the connection bar 283*c* and is provided in a disc, hemisphere and sphere shape. Accordingly, the connection unit 283 may be stably coupled to the first and second supports 281 and 282.

Meanwhile, the second laundry treating unit 200 may include a second drive unit 300 configured to rotate the second drum 240 in the second tub 220.

The second drive unit 300 may include a second stator 310 provided in a bottom surface of the second tub 220 and configured to generate a rotation magnetic field; a second rotor 320 rotatable by the rotation magnetic field of the second stator 310; and a drive rotation shaft 330 having one end connected with the second rotor and the other end connected to the second drum 240 through the second tub 220.

The second drum 240 may include a drum introduction opening 241 communicable with the second opening 211 and a balancer 242 coupled to an outer circumferential surface of the drum introduction opening 241 and configured to prevent eccentricity of the second drum 240.

Meanwhile, the second drum 240 may include a plurality of through-holes 243*a* provided in an inner circumferential surface of the second drum 240 and to draw or discharge the water of the second tub 220.

The second drum 240 may be rotated by the second drive unit 300 and a mechanical force may be applied to the laundry held in the second drum 240 to wash the laundry.

Also, the second drum 240 may be rotated by the second drive unit 300 to perform a spin cycle configured to discharge the moisture contained from the laundry through the through-holes 241.

Meanwhile, the drum bottom 244 may have a penetrating hole 244*a*; and an agitation unit 600 rotatable in the penetrating hole 244*a*.

The agitation unit 600 may be rotatable independently from the drum body 243 to agitate the laundry. In other words, the agitation unit 600 may be configured to apply a mechanical force to the laundry held in the second drum 240 so as to wash the laundry.

The agitation unit 600 may include an agitation unit body 610 provided as a main body; a central portion 611 provided in a center of the agitation unit body; and a agitation arm 612 radially projected from the central portion 611 and configured to agitate the laundry.

Accordingly, the agitation unit 600 may form a water current in the second drum 240 by repeating the rotation in the clockwise or counter-clockwise direction and then enhance the washing efficiency for the laundry.

Meanwhile, the agitation unit 600 may be rotatable in a state of being connected with the drive rotation shat 330 and rotatable in a state of being independent from the second drum 240.

However, when the agitation unit 600 is rotated in a state where the second drum 240 is paused or in the reverse direction of the second drum 240, the laundry held in the second drum 240 might be entangled.

A sufficient mechanical force may be applied to the laundry in the wash cycle advantageously when one of the agitation unit 600 and the second drum 240 is rotated or both of them are rotated in the reverse directions.

However, if only one of the agitation unit 600 and the second drum 240 is rotated at a high speed or both of them are rotated at a high speed in the reverse directions, the entanglement of the laundry becomes severe and might cause damage to the fabric of the laundry.

Accordingly, it is preferred that the agitation unit 600 and the second drum 240 are rotated at the same time in the spin cycle configured to rotate the second drum 240 at a high speed.

Hereinafter, referring to FIGS. 3 through 5, the structure will be described that the second drum 240 and the agitation unit 600 are rotated independently in the wash cycle and simultaneously in the spin cycle.

As one example, while they are rotatable independently in the wash cycle, the agitation unit 600 and the drum 240 may be rotated simultaneously in the spin cycle.

Figure 3:
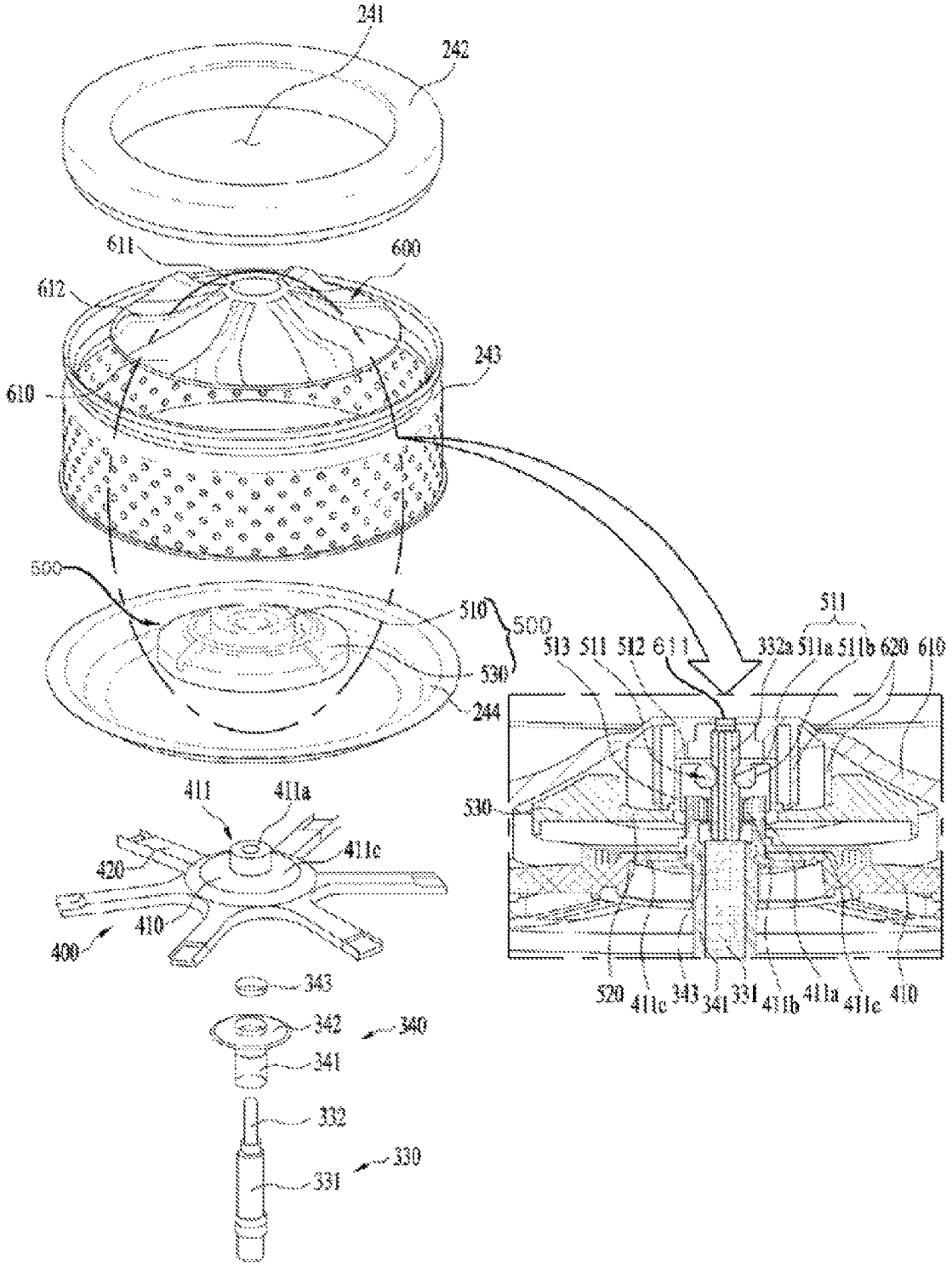
FIG. 3 is a diagram illustrating one embodiment of a drum, a pulsator and a drive unit that are provided in the laundry treating apparatus.
Figure 4:
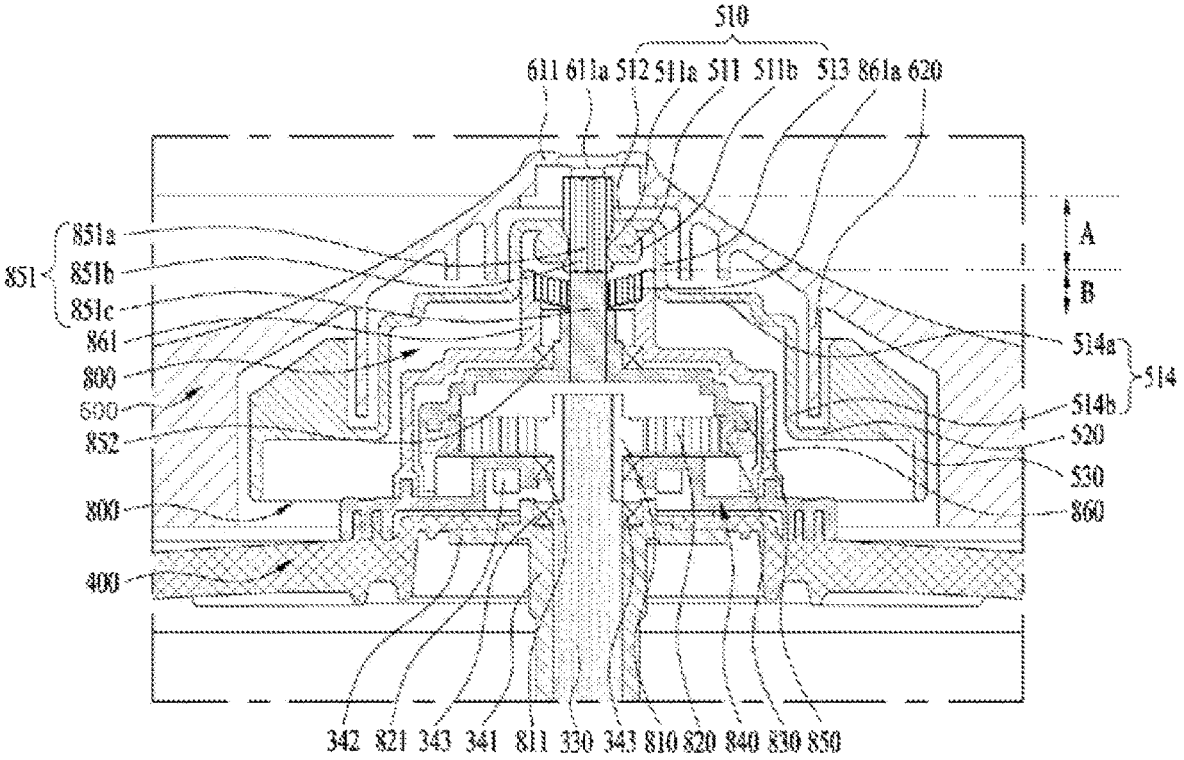
FIG. 4 is a diagram illustrating one embodiment that a coupling ring rises and falls according to a water level.

FIGS. 3 and 4 illustrate one embodiment that only the agitation unit 600 is rotated or both of the second drum 240 are rotated simultaneously.

The second drive unit 300 may be provided in a lower area of the agitation unit 600 and configured to provide a driving force for rotating at least one of the agitation unit 600 and the second drum 240.

The second laundry treating apparatus 200 may include a coupling 500 provided between the agitation unit 600 and the second drive unit 300 and configured to be supplied the drive force of the second drive unit 300 to be rotatable. The structure of the coupling 500 supplied the drive force by the second drive unit 300 will be described later.

The coupling may be provided in the second tub 220 and specifically provided under the agitation unit 600.

The coupling 500 may be configured to rotate the agitation unit 600 and the second drum 240 in the different directions or only the agitation unit 600, when a water level is a preset level or more in the second tub 220, and both of them in the same direction when the water level is a preset level or lower. In this instance, the coupling 500 may be made of a material having a smaller specific gravity than water.

As one example, the coupling 500 may be made of plastic and engineering plastic or reinforced plastic for reinforcement. Accordingly, when water is supplied to the second tub 220, the coupling may rise towards the agitation unit 600. When water is discharged from the second tub 220, the coupling may go down farther from the agitation unit 600.

Generally, in the wash cycle configured to remove foreign substances by applying the mechanical force to the laundry, the water level of the second tub 220 may be a preset level or more. In the spin cycle configured to remove moisture from the laundry by rotating the second drum 240 at a high speed, the water level of the second tub 220 may be lower than a preset water level. Accordingly, the preset water level may be defined as the water level at which the agitation unit 600 is exposed to air.

Specifically, the coupling 500 may be configured to rotate both of the agitation unit 600 and the second drum 240 in the different directions or only the agitation unit 600. During the spin cycle, the coupling may be configured to rotate both of the agitation unit 600 and the second drum 240 in the different directions.

In other words, the coupling 500 may change the rotational direction of the agitation unit 600 and the second drum 240 based on the water level of the second tub 220

The second laundry treating apparatus 200 may further include a shaft fixing unit 400 provided to connect the second drive unit 300 with the bottom surface 240 of the second drum 240.

The shaft fixing unit 400 may be coupled to an outer circumferential surface of the penetrating hole 244*a* of the second drum 240. Accordingly, once the shaft fixing unit 400 is rotated, the drum body 244 may be rotated. Once the shaft fixing unit 400 is stopped, the drum body 244 may be stopped.

In other words, the shaft fixing unit 400 may be configured to rotate the second drum 240.

At this time, the coupling 500 may be coupled to the shaft fixing unit 400 and configured to transmit the drive force to the second drum 240 when the water level is a preset level or less in the second tub 220. When the water level is a preset level or more in the second tub 220, the coupling 500 may be decoupled from the shaft fixing unit 400 and the drive force may be shut off from being transmitted to the second drum 240.

Specifically, the coupling 500 may be separated from the shaft fixing unit 400 and rise towards the agitation unit 600, when the water level is a preset level or more in the second tub 220. The coupling may go down and be coupled to the shaft fixing unit 400, when the water level is less than the preset water level.

The coupling 500 may be directly provided with the drive force by the second drive unit 300. Accordingly, when the water level is the preset level or more, the coupling 500 may be coupled to the agitation unit 600 and rotate only the agitation unit 600. When the water level is less than the preset level in the second tub 220, the coupling 500 may be coupled to the shaft fixing unit 400 and rotate shaft fixing unit 400.

Hereinafter, the structure configured to be supplied the drive force from the drive unit 300 and selectively rotate the shaft fixing unit 400 will be described.

The second drive unit 300 may include a shaft accommodating portion 340 configured to rotatably accommodate the drive rotation shaft 330, with the drive rotation shaft penetrated there through. The shaft fixing unit 400 may include a hub 410 having a shaft The shaft fixing unit 400 may include a hub 410 having a shaft accommodation unit 400 coupled to a lower area and the drive rotation shaft 330 passing there through; and a fixing arm 420 radially extended from the hub 410 and coupled to the bottom surface 244 of the drum.

The drive rotation shaft 330 is rotated by the second stator 251 and the second rotor 252, while not directly rotating the shaft fixing unit 400 via the shaft accommodation unit 340. In other words, the drive rotation shaft 330 may be freely rotatable in the shaft accommodating portion 340, with penetrating the shaft fixing unit 400.

In this instance, the agitation unit 600 may be coupled to an end of the drive rotation shaft 330 to be rotatable together with the drive rotation shaft 330. Specifically, the drive force generated in the second drive unit 300 may be directly transmitted to the agitation unit 600. However, the drive force generated in the second drive unit 300 may not be directly transmitted to the shaft fixing unit 400.

Meanwhile, the coupling 500 may be vertically movable in an upper area of the hub 410 along the drive rotation shaft 330 by the variation of the water level in the second tub 220.

The coupling 500 may include a power transmission unit 510 coupled to the drive rotation shaft 330 and configured to receive the drive force of the second drive unit 300.

The drive rotation shaft 330 may include a shaft body 331 connected with the second rotor 320; a shaft gear portion 332 extended from the shaft body 331 and having a first gear 332*a* provided in an outer circumferential surface of the area projected from the hub 410. The shaft penetrating unit 411 may include a hub gear 411*a* partially accommodating the shaft gear portion 332, spaced a preset distance from the shaft gear portion 322, and including a second gear 411*b* provided in an inner circumferential surface.

Specifically, the drive rotation shaft 330 may include the first gear 332*a* provided in the area upwardly projected from the hub 410.

The power transmission unit 510 may include a third gear 511*a* provided in the inner circumferential surface and configured to move along the longitudinal direction of the shaft gear portion 332 to engage with the first gear 332*a*; and a fourth gear 511*b* provided in an outer circumferential surface and configured to engage with the second gear 411*b* when the power transmission unit 510 is inserted between the shaft gear portion 332 and the hub gear 411*a*.

The power transmission unit 510 may rise along the longitudinal direction of the shaft gear portion 332 when water is supplied to the second tub 220 and move down along the longitudinal direction of the shaft gear portion 332 when the water is discharged from the second tub 220, so as to be inserted between the shaft gear portion 332 and the hub gear 411*a*.

In other words, as the third gear 511*a* engages with the first gear 322*a* of the shaft gear portion 332, the power transmission unit 510 may directly receive the drive force of the drive shaft 330.

Accordingly, the power transmission unit 510 inserted between the shaft gear portion 332 and the hub gear 441*a* may be separated and rise, when the water level is a preset level or more in the second tub 220 by the water supplied to the second tub 220.

Accordingly, even when the shaft gear portion 332 is rotated, the hub gear 441*a* will not be rotated and the shaft fixing unit 400 and the second drum 240 will not be rotated. In this instance, when the power transmission unit 510 contacts with the lower area of the agitation unit 600, the coupling 500 may rotate the agitation unit 600. Once it is fixed to an upper end of the shaft gear portion 332, the agitation unit may be continuously rotated together with the drive rotation shaft 330.

During the wash cycle, the second drum 240 may be secured and only the agitation unit 600 is rotated such that the water current may be formed in the second drum 240 only to enhance the washing efficiency.

When the water level is less than the preset water level in the second tub 220 after the water is discharged from the second tub 220, the power transmission unit 510 may be inserted in the shaft gear portion 332 and the hub gear 441*a*.

At this time, the fourth gear 551*b* of the coupling gear may engage with the second gear 411*b* of the hub gear. When it is rotated by the shaft gear portion 332, the power transmission unit 510 may rotate the hub gear 411*a*.

Accordingly, the power transmission unit 510 may transmit the drive force generated in the second drive unit 300 to the shaft fixing unit 400 via the hub gear 411*a* and rotate the second drum 240.

In this instance, the agitation unit 600 may be rotated together with the shaft gear portion 332 such that the agitation unit 600 and the second drum 240 may be rotated simultaneously.

During the spin cycle, the agitation unit 600 and the second drum 240 may be integrally rotated such that the entanglement of the laundry can be eased off.

Meanwhile, the coupling 500 may further include a fixing plate 512 extended from an upper area of the coupling gear 511 to fix the coupling gear thereto; and an accommodating rib 513 extended from one end of the fixing plate 512 to detachably accommodate the hub gear 4' 11*a*.

Specifically, the accommodating rib 513 and the fixing plate 512 may define some space formed in a lower are to accommodate the hub gear 411*a*. The space may be provided with water. The water supplied to the second tub 220 is able to float the coupling 500.

Meanwhile, the coupling 500 may further include an extended rib 520 extended from the accommodating rib 513; and an agitation coupling unit 530 projected from one end of the extended rib and detachably coupled to a lower area of the agitation unit 600.

The agitation coupling unit 530 and the extended rib 520 may form a predetermined space in the lower area to contact with water or allow water drawn therein. Accordingly, the coupling 500 may float in the water well.

Meanwhile, the agitation unit 600 may be projected upwardly to detachably accommodate the coupling 500 in a lower area of the central portion 611. The agitation unit 600 may further include a coupling rib 620 downwardly extended from the central portion 611 to accommodate the power transmission unit 510 and detachably coupled to the extended rib 520.

Accordingly, the contact power of the agitation unit 600 with the coupling may be reinforced. At this time, the agitation unit 600 is not fixed to the drive rotation shaft 330 but freely rotated by the drive rotation shaft 330. In this instance, the agitation unit 600 may contact with the power transmission unit 510, the agitation coupling unit 530 and the extended rib 520 of the coupling 500 such that it can be rotated together with the coupling 500 when the coupling 500 is rotated.

Meanwhile, the shaft accommodating portion 340 may include an accommodating pipe 341 partially accommodating the drive rotation shaft 330; and an accommodation fixing portion 342 extended from a top of the accommodating pipe 341 and coupled to a lower area of the hub 410. Accordingly, the drive rotation shaft 330 is independently rotated from the shaft accommodating portion 340 not to directly transmit the drive force to the shaft fixing unit 400.

The shaft accommodating portion 340 may further include an accommodating bearing 343 provided in an inner circumferential surface of the accommodating pipe 341 and configured to shut off the drive force of the drive rotation shaft 330 from being transmitted to the shat accommodating portion 340 and induce the free rotation of the drive rotation shaft 330 at the same time.

Meanwhile, the shaft penetrating unit 411 may further include a hub coupling portion 411*c* independently provided from the hub 410 to be detachably coupled to the hub 410 and extended from an outer circumferential surface of the hub gear 411*a* to be coupled to the hub 410.

As the shape of the hub 410 is complicated, it is advantageous when it is difficult to fabricate the shaft penetrating portion 411 at one go.

FIG. 4 is a diagram illustrating location variation of the coupling 500 based on the water level of the second tub 220.

Referring to FIG. 4 (*a*), when the water level reaches a preset level in the second tub 220, water may be drawn into a lower area of the coupling 500 and the coupling 500 may rise. At this time, the coupling 500 may rise until the upper area of the coupling 500 contacts with the lower area of the central portion 611.

The coupling 500 may be rotated by the shaft gear portion 332 and rotate the agitation unit 600. At this time, the coupling 500 is separated from the hub gear 411*a* and it may not rotate the shaft fixing unit 400.

Accordingly, when the water level is the preset level or more in the second tub 220, only the agitation unit 600 may be rotated. Once the wash cycle starts, the water current may be formed in the second drum 240 and the laundry may be entangled enough to enhance the washing efficiency.

Referring to FIG. 4 (*b*), when the water level is less than the predetermined level in the second tub 220, the water is discharged from the lower area of the coupling 500 and the coupling 500 move down. At this time, the coupling 500 moves down until the power transmission unit 510 of the coupling 500 is inserted between the hub gear 411*a* and the shaft gear portion 332.

In this instance, when it is rotated by the rotation of the shaft gear portion 332, the coupling may rotate even the hub gear 411*a*.

The agitation coupling portion 530 of the coupling is sufficiently projected and the coupling rib 620 of the agitating unit 600 contacts with the upper surface of the coupling 500. In this case, the coupling 500 may rotate the agitation unit 600 while rotated.

When the central portion 611 of the agitation unit 600 is fixed to the upper end of the shaft gear portion 332, even the agitation unit 600 may be rotated together with the shaft gear portion 332.

At this time, the shaft gear portion 332, the coupling gear 511 and the hub gear 411*a* may be rotated at the same speed.

Accordingly, the shaft fixing unit 400 and the agitation unit 600 may be rotated together at the same time, to deduce an effect of integrally rotating both of them.

While the spin cycle is operated, the second drum 240 may be rotated together with the agitation unit 600 at the same time. The entanglement of the laundry may be eased off enough to prevent the damage to the fabric of the laundry.

Figure 5:
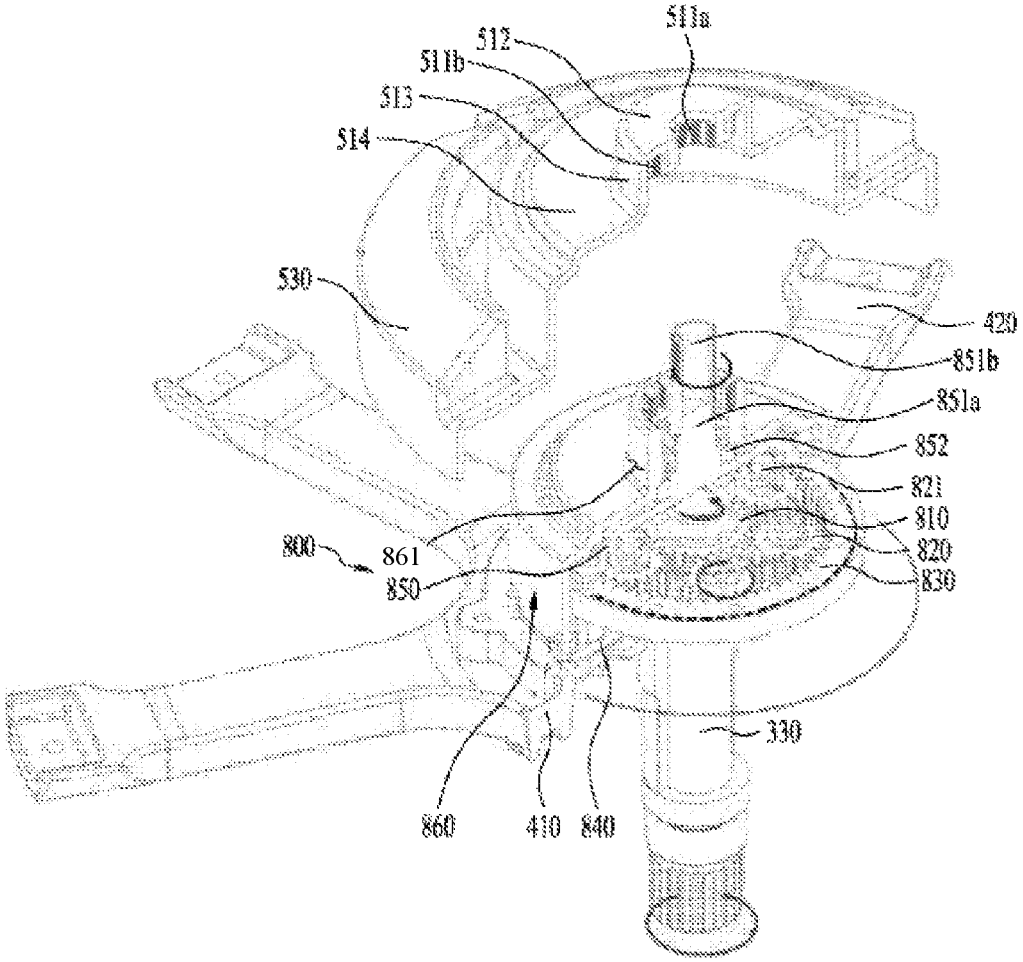
FIG. 5 is a diagram illustrating another embodiment of the drum, the pulsator and the drive unit that are provided in the laundry treating apparatus.
Figure 6:
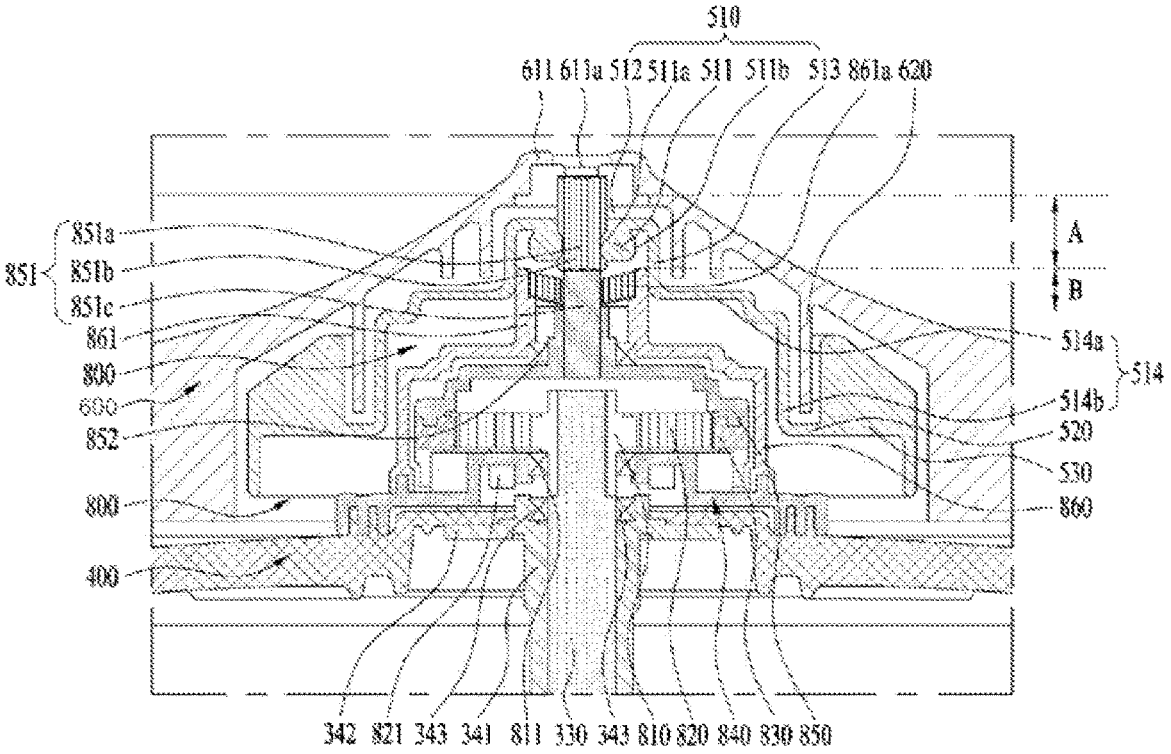
FIG. 6 is a diagram illustrating a structure of a gear box.

Hereinafter, FIGS. 5 and 6 illustrate one embodiment configured to rotate the agitation unit 600 and the second drum 240 in the reverse direction or rotate both of the, at the same time.

While the wash cycle is performed, the agitation unit 600 and the second drum 240 may be rotated in the reverse directions and then a sufficient mechanical force may be applied to the laundry. Accordingly, it is more advantageous to.

Even when the spin cycle is performed, it is more advantageous to rotate the agitation unit 600 and the second drum 240 at the same time so as to each off the entanglement of the laundry.

Referring to FIGS. 5 and 6, the second drive unit 300 may include a gear box 800 provided to rotate the agitation unit 600 in the reverse direction of the rotating second drum 240.

The gear box 800 may be provided in an upper area of the hub 410 and coupled to one end of the drive rotation shaft 330 and supplied the drive force of the second drive unit 300 such that the agitation unit 600 can be rotated in the reverse direction of the rotating second drum 240.

At this time, the coupling 500 may be provided between the agitation unit 600 and the gear box 800 to be supplied the drive force of the gear box 800, when the water level is a preset level or more I n the second tub 220 and the drive force of the hub 410, when the water level is less than the preset level Specifically, the gear box 800 may include a sun gear 810 coupled to one end of the drive rotation shaft 300 and rotatable together with the drive rotation shaft 330; at least one planet gear 820 configured to engage with the sun gear 810 and revolve along an outer circumferential surface of the sun gear 810; a ring gear 830 provided in an outer circumferential surface of the planet gear 820 and configured to be rotatable while engaging with the planet gear 820; a carrier 840 provided to rotatably accommodate a shaft 821 of the planet gear 820 and coupled to the hub while rotated in a same direction with the revolving direction of the planet gear 820; a rotation housing 850 coupled to an upper area of the ring gear 830 and configured to be rotatable together with the ring gear 830 in the reverse direction of the rotating carrier 840; a body shaft 851 coupled to an upper area of the rotation housing 850; and a gear housing 860 accommodating the rotation housing 850 to allow the body shaft 851 to be projected there through and coupled to the carrier 840.

Meanwhile, a sun bearing 811 may be further provided between the sun gear 810 and the carrier 840 and configured to rotate the carrier 840 in the sun gear 810 freely.

A housing bearing 852 may be further provided between the gear housing 860 and the body housing 850 and configured to rotate them independently. The housing bearing 852 may function as the sealing unit to prevent the water of the second tub 220 from permeating into the gear housing 860.

The gear housing 860 may be employed to prevent water from permeating into the gear box 800.

In other words, the sun gear 810 may be rotatable in the same direction with the drive rotation shaft 330 to rotate the planet gear 820. The planet gear 820 may be revolved around the rotation direction of the sun gear 810, while rotating in the reverse direction of the sun gear 810.

The planet gear shaft 821 of the planet gear 820 is fixed through the carrier 840 carrier 840 and the carrier 840 may be rotated in the same direction of the rotating sun gear 810 along the revolving direction of the planet gear 820.

Also, the carrier 840 is coupled to the hub 410 and configured to rotate the shaft fixing unit 400 in the same direction of the sun gear 810.

Meanwhile, the ring gear 830 may be rotated in the reverse direction of the sun gear 810 by the counter-action of the planet gear rotation. Accordingly, the rotation housing 850 coupled to the upper area of the ring gear 830 may be rotated in the reverse direction of the sun gear 810. The body shaft 851 provided in the upper area of the rotation housing 850 may be rotated in the reverse direction of the sun gear 810.

Meanwhile, the gear housing 860 may be coupled to the upper surface of the carrier 840 and configured to accommodate the rotation housing 850 such that it may be rotated in the same direction of the carrier 840.

The gear housing 860 is connected with the carrier 840 and the carrier 840 is connected with the shaft fixing unit 400. When the drive rotation shaft 330 is rotated, the shaft fixing unit 400 may be always rotatably provided.

In other words, the gear housing 860 and the body shaft 851 may be rotated in the reverse directions, respectively.

Accordingly, the drive force of the second drive unit 300 may be transmitted to the gear housing 860 and the body shaft 851, respectively.

The coupling 500 may be supplied the drive force from the gear housing 860 or the body shaft 851.

At this time, the power transmission unit 510 of the coupling 500 may be coupled to the outer circumferential surface of the body shaft 851 and then vertically movable along the longitudinal direction of the body shaft 851. Accordingly, when the water level is the preset water level or more in the second tub 220, the drive force of the body shaft 851 may be transmitted. When the water level is less than the preset level, the coupling may be coupled to the gear housing 860 and the drive force of the gear box 800 may be transmitted from the gear housing 860.

Meanwhile, the agitation unit 600 may be coupled to one end of the body shaft 851 but rotatable with no relation with the body shaft 851.

Specifically, the agitation unit 600 may be freely rotatable in the body shaft 851. When the agitation unit 600 is fixedly coupled to the body shaft 851, the body shaft 851 maybe always rotatable in the reverse direction of the gear housing 860 and not rotatable in the same direction with the second drum 240.

Accordingly, the agitation unit 600 may include center column 611*a* rotatably inserted in the penetrating hole provided in the end of the body shaft 851.

The penetrating hole provided in the body shaft 851 may accommodate the center column 611*a*, without transmitting the drive force to the center column 611*a*. The gear housing 860 may include a housing gear 861 provided in an upper area of the gear housing 860 and configured to accommodate at least predetermined area of the body shaft 851, spaced a preset distance apart from the body shaft 851, the housing gear 861 including a fifth gear provided in an inner circumferential surface. The body shaft 851 may further include a body gear portion 851*a* having a sixth gear 851*b* provided in an outer circumferential surface of the area projected from the housing gear 861.

In other words, the body shaft 851 may have the sixth gear 851*b* provided in an outer circumferential surface of the area located higher than the housing gear 861 and a cylinder portion 851*c* having a flat outer circumferential surface located lower than the housing gear 861.

In other words, the body shaft 851 may have the body gear portion 851*a* provided in 'A' area and the cylinder portion 851*c* may be provided in 'B' area.

Specifically, the body shaft 851 may be extended a predetermined area from the housing body 850 as the cylinder portion 851*c* and the body gear portion 851*a* may be provided in the other area.

Accordingly, the power transmission unit 510 may be supplied the drive force from the body shaft 851 when located in the body gear portion 851*a* but not supplied the drive force when located in the cylinder portion 851*c*.

Accordingly, the coupling 500 may be separated from the area between the housing gear 861 and the body shaft 851 and rise towards the body gear portion 851*a*, when the water level is the preset level or more in the second tub 220. At this time, the third gear 511*a* provided in the inner circumferential surface of the power transmission unit 510 may be rotated together with the body shaft 851, while engaging with the sixth gear 851*b*.

In this instance, the upper surface of the coupling 500 may contact with the power area of the central portion 611 provided in the agitation unit and the agitation unit body 610 may be rotated together with the coupling 500.

Accordingly, the agitation unit 600 and the second drum 240 may be rotated in the reverse directions, respectively.

The coupling 500 may move down along the longitudinal direction of the body shaft 851 and be inserted between the housing gear 861 and the body shaft 851, when the water level is less than the preset level in the second tub 220.

At this time, the fourth gear 611*b* of the power transmission unit 510 may engage with the fifth gear 861*a* provided in the housing gear and the third gear 511*a* may be arranged in an outer circumferential surface of the body shaft 851.

Once the housing gear 861 is rotated by the rotating gear housing 860, the coupling 500 and the gear housing 860 may be rotated simultaneously.

At this time, the coupling 500 may be spaced a preset distance from the agitation unit 600 but the agitation coupling portion 530 may contact with the extended rib 520 extended from the lower area of the agitation unit 600, such that the agitation unit 600 may be rotated.

Accordingly, the agitation unit 600 and the second drum 240 may be rotatable in the same direction.

In other words, the power transmission unit 510 of the coupling 500 may be provided like the power transmission unit 510 shown in FIGS. 3 and 4.

More specifically, the power transmission unit 510 of the coupling 500 may include a coupling gear 511 including the third gear 511*a* provided in the inner circumferential surface and the fourth gear 511*b* provided in the outer circumferential surface. In addition, the power transmission unit 510 may further include a fixed plate 512 extended from an upper area of the coupling gear 511 to fix the coupling gear; and an accommodating rib 513 extended from one end of the fixed plate to detachably accommodate the housing gear.

Figure 7:
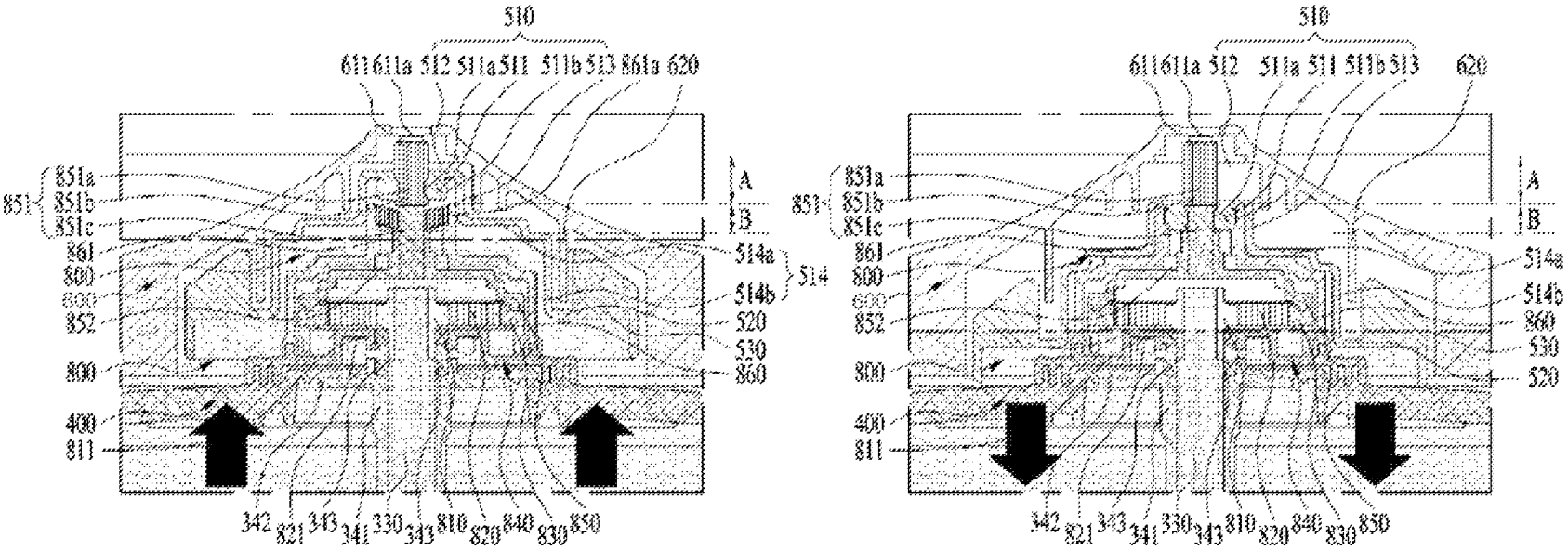
FIG. 7 is a diagram illustrating one embodiment that the coupling rises and falls according to a water level.

However, the coupling 500 shown in FIGS. 5 through 7 has to accommodate the gear housing 860 and it may further include a housing rib 514 extended from one end of the accommodating rib to detachably accommodate gear housing.

The housing rib 514 may include a first housing rib 514*a* provided in parallel with an upper surface of the gear housing 860; and a second housing rib 514*b* provided in parallel with an outer circumferential surface of the gear housing 860.

The housing rib 514 may define the space in the lower area to receive water to facilitate the coupling 500 to easily float on the water.

At this time, the extended rib 520 may be extended from the housing rib 514 and the agitation coupling portion 530 may be projected from one end of the extended rib 520 to be detachably coupled to the lower area of the agitation unit and provide the predetermined space for accommodating the water.

Specifically, the coupling 500 shown in FIG. 3 may be equal to the coupling 500 shown in FIG. 5, except the presence of the housing rib.

The agitation unit 600 may be upwardly projected to detachably accommodate the coupling 500 in the lower area of the central portion 611 and further include a coupling rib 620 downwardly extended from the central portion 611 to seat the power transmission unit 510 in the extended rib 520.

Accordingly, the contact force of the agitation unit 600 with the coupling 500 may be reinforced.

FIG. 7 illustrates the movement of the coupling 500 based on the water level of the second tub 220.

Referring to FIG. 7 (*a*), when the water level is a preset level or more in the second tub 220, water is drawn into the lower area of the coupling 500 and the coupling 500 rises. At this time, the coupling 500 may move up until the upper area of the coupling 500 reaches the lower area of the central portion 611.

The coupling 500 may be rotated by the body shaft 851 so as to rotate the agitation unit 600. The coupling 500 may be separated from the housing gear 861 and then the shaft fixing unit 400 may not be rotated.

When the water level is a preset level or more in the second tub 220, the agitation unit 600 and the second drum 240 may be rotated in the reverse directions. In this instance, if the wash cycle is performed, a water current may be formed smoothly in the second drum 240 and the laundry will be entangled properly enough to enhance the washing efficiency.

Referring to FIG. 7 (*b*), when the water level is less than the preset level in the second tub 220, the water may be discharged from the lower area of the coupling 500 and the coupling 500 may move down. At this time, the coupling may move down until the power transmission unit 510 is inserted between the housing gear 861 and the cylinder portion 851*c* of the body shaft.

At this time, the coupling may be rotated together with the housing gear 861 simultaneously, when the housing gear 861 is rotated in the carrier 840. Only when the agitation coupling portion 530 of the coupling 500 may be projected sufficiently and the coupling rib 620 of the agitation unit 600 is able to contact with the upper surface of the coupling 500, the rotating coupling 500 may rotate the agitation unit 600 in the same direction of the housing gear 861.

The carrier 840 may be fixed to the shaft fixing unit 400 and even the second drum 240 may be rotated in the same direction with the carrier 840. Accordingly, the agitation unit 600 and the second drum 240 may be rotated in the same directions. The shaft fixing unit 400 and the agitation unit 600 may be rotated simultaneously such that the same effect of rotating them as one body integrally may be induced. In this state, when the spin cycle is performed, the second drum 240 and the agitation unit 600 are rotated simultaneously such that the entanglement of the laundry may be eased off enough to prevent the damage to the fabric.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treating apparatus comprising:

a cabinet that defines an exterior of the laundry treating apparatus;

a tub disposed in the cabinet and configured to receive water, the tub defining an opening at a top surface of the tub;

a drum rotatably disposed in the tub and configured to accommodate laundry, the drum defining a through-hole at a bottom surface;

an agitation unit rotatably disposed in the through-hole;

a drive unit disposed vertically below the agitation unit and configured to supply a drive force to at least one of the agitation unit or the drum, the drive unit including (i) a drive rotation shaft that includes a shaft body extending in a vertical direction and (ii) a first gear that extends upward from the shaft body;

a shaft fixing unit fixed to the drum, the drive rotation shaft passing through the shaft fixing unit;

a hub gear that defines a hollow space receiving the first gear, that extends in the vertical direction, and that is fixed to the shaft fixing unit, the hub gear including a second gear that is disposed at an inner surface of the hub gear and spaced apart from the first gear; and a coupling device configured to be rotated by the drive force and disposed between the agitation unit and the drive unit, the coupling device being configured to move along a longitudinal direction of the first gear between a first position corresponding to the hub gear and a second position that is above the first position, wherein the coupling device comprises a power transmission unit coupled to the drive rotation shaft and configured to receive the drive force from the drive unit, and wherein the power transmission unit comprises:

a coupling gear including (i) a third gear that is disposed at an inner circumferential surface of the coupling gear and configured to engage with the first gear and (ii) a fourth gear that is disposed at an outer circumferential surface of the coupling gear and configured to engage with the second gear in the first position and to be separated from the second gear in the second position, a fixed plate that extends from an upper part of the coupling gear, the coupling gear being fixed to the fixed plate, and an accommodating rib that extends from one end of the fixed plate and is configured to detachably accommodate the hub gear.

2. The laundry treating apparatus of claim 1, wherein the agitation unit is coupled to one end of the drive rotation shaft.

3. The laundry treating apparatus of claim 1, wherein the coupling device comprises:

an extended rib that extends from the accommodating rib; and an agitation coupling unit that protrudes from one end of the extended rib and that is configured to detachably couple to a lower portion of the agitation unit, the agitation coupling unit defining a water space configured to accommodate water at a lower area of the agitation coupling unit.

4. The laundry treating apparatus of claim 3, wherein the agitation unit comprises:

an agitation unit body;

a central portion that is disposed at a center region of the agitation unit body and that is coupled to one end of the first gear, the central portion being configured to rotate together with the first gear; and an agitation arm that radially extends from the central portion and that is configured to agitate the laundry in the drum, and wherein the central portion protrudes upward from the agitation unit body, and has a lower portion configured to detachably accommodate the coupling device.

5. The laundry treating apparatus of claim 4, wherein the agitation unit further comprises:

a coupling rib that extends downwardly from the central portion and that is configured to seat the power transmission unit in the extended rib.

6. The laundry treating apparatus of claim 1, wherein the coupling device is made of a material having a specific gravity that is less than a specific gravity of water.

7. A laundry treating apparatus comprising:

a first cabinet that defines a first opening at a front surface of the first cabinet;

a second cabinet disposed on a top surface of the first cabinet, the second cabinet defining a second opening at a top surface of the second cabinet;

a tub disposed in the second cabinet and configured to receive water, the tub defining an introduction opening that is in communication with the second opening;

a drum rotatably disposed in the tub and configured to accommodate laundry, the drum defining a penetrating hole at a bottom surface of the drum;

an agitation unit rotatably disposed in the penetrating hole;

a drive unit disposed vertically below the agitation unit and configured to supply a drive force for rotating at least one of the agitation unit or the drum, the drive unit including (i) a drive rotation shaft that includes a shaft body extending in a vertical direction and (ii) a first gear that extends upward from the shaft body;

a shaft fixing unit fixed to the drum, the drive rotation shaft passing through the shaft fixing unit;

a hub gear that defines a hollow space receiving the first gear, that extends in the vertical direction, and that is fixed to the shaft fixing unit, the hub gear including a second gear that is disposed at an inner surface of the hub gear and spaced apart from the first gear; and a coupling device disposed between the agitation unit and the drive unit and configured to rotate based on the drive force, the coupling device being configured to move along a longitudinal direction of the first gear between a first position corresponding to the hub gear and a second position that is above the first position, wherein the coupling device comprises a power transmission unit coupled to the drive rotation shaft and configured to receive the drive force from the drive unit, and wherein the power transmission unit comprises:

a coupling gear including (i) a third gear that is disposed at an inner circumferential surface of the coupling gear and configured to engage with the first gear and (ii) a fourth gear that is disposed at an outer circumferential surface of the coupling gear and configured to engage with the second gear in the first position and to be separated from the second gear in the second position, a fixed plate that extends from an upper part of the coupling gear, the coupling gear being fixed to the fixed plate, and an accommodating rib that extends from one end of the fixed plate and is configured to detachably accommodate the hub gear.

8. The laundry treating apparatus of claim 1, wherein the shaft fixing unit comprises:

a hub;

a fixing arm that radially extends from the hub and is coupled to a bottom of the drum; and a shaft penetrating portion including the hub gear and a hub coupling portion that extends from an outer circumferential surface of the hub gear and is coupled to the hub.

9. The laundry treating apparatus of claim 8, further comprising a shaft accommodation unit configured to rotatably accommodate the drive rotation shaft, the drive rotation shaft passing through the shaft accommodation unit, wherein the shaft accommodation unit comprises:

an accommodation pipe configured to rotatably accommodate a predetermined area of the drive rotation shaft;

an accommodation fixing portion that extends from an upper area of the accommodation pipe and that is coupled to the hub; and an accommodation bearing disposed at an inner circumferential surface of the accommodation pipe and configured to cut off transmission of the drive force of the drive rotation shaft to the shaft accommodation unit.

* * * * *